United States Patent [19]

Jinno

[11] 4,197,014

[45] Apr. 8, 1980

[54] ASPHALT REGENERATING APPARATUS

[76] Inventor: Michio Jinno, 6-3 Yasuda-dori, Showa-ku, Nagoya-shi, Aichi-ken, Japan

[21] Appl. No.: 952,209

[22] Filed: Oct. 17, 1978

[30] Foreign Application Priority Data

Sep. 4, 1978 [JP] Japan ..... 53/107452

[51] Int. Cl.[2] ..... B28C 1/22

[52] U.S. Cl. ..... 366/24; 106/280

[58] Field of Search ..... 366/7, 24, 25, 33; 106/280–283; 208/39

[56] References Cited

U.S. PATENT DOCUMENTS

| | | | |
|---|---|---|---|
| 505,416 | 9/1893 | Bell | 209/173 X |
| 1,456,492 | 5/1923 | Hepburn | 106/283 |
| 2,413,908 | 1/1947 | Chester | 366/25 X |
| 2,459,520 | 1/1949 | Greenshields | 106/283 |
| 3,305,474 | 2/1967 | Knowles et al. | 208/39 |
| 3,984,920 | 10/1976 | Raymond et al. | 34/134 |
| 4,000,000 | 12/1976 | Mendenhall | 106/280 |
| 4,025,057 | 5/1977 | Shearer | 366/25 |

FOREIGN PATENT DOCUMENTS

| | | | |
|---|---|---|---|
| 891731 | 3/1962 | United Kingdom | 366/25 |

*Primary Examiner*—Leonard D. Christian
*Attorney, Agent, or Firm*—George A. Loud

[57] ABSTRACT

An asphalt regenerating apparatus including a drum in which blade means is provided and hot water is contained is disclosed. The asphalt waste is introduced into the drum and heated by the hot water contained in the drum. By revolving the blade means, the heated asphalt waste is subdivided, thereby becoming aggregate particles each having the surface coated with a thin asphalt film.

9 Claims, 11 Drawing Figures

ASPHALT REGENERATING APPARATUS

This invention relates to an asphalt recycle system.

Several methods for recycling the asphalt mixture used for road pavement works have been proposed. The known recycling methods include those of crushing the used asphalt mixture, or exposing the mixture to steam. The present inventor has searched for an asphalt recycle system in which the asphalt mixture is regenerated by subdividing the mixture in the heated water.

The object of this invention is to provide an improved asphalt recycle system in which the used asphalt mixture is regenerated by the hot water. The present invention will be more clearly understood when considered in conjunction with the accompanying drawings, in which.

Preferred embodiments of the present invention will be explained.

Figure 1:
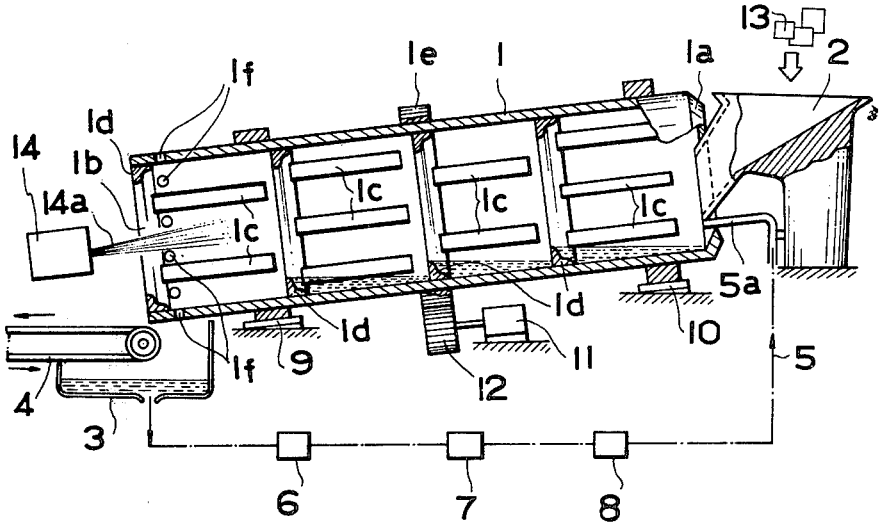
FIG. 1 is a schematic illustration of an asphalt recycling apparatus according to an embodiment of the present invention.

In FIG. 1, an heating drum 1 is inclined. One end of the drum 1 has an entrance 1*a* through which the used asphalt mixture or waste 13 is fed into the drum 1 from an introducing device such as an chute 2. The other end of the drum 1 has an exit 1*b* through which a regenerated or recycled asphalt mixture is brought out to a conveyer 4. Several openings 1*f* are formed near the exit 1*b* of the drum 1. A pipe 5 for circulating water is provided between the bottom of the water receptacle 3 and the entrance 1*a* of the drum 1. A purifier 6, a pump 7 and a heater 8 are arranged in the pipe 5.

Many elongate and straight blades 1*c* are fixed on the inner surface of the drum 1 in an axial direction of the drum 1. Several low circular dams 1*d* are provided on the inner surface of the drum 1 between the blades 1*c*.

The drum 1 is rotatably supported by supporting means such as rollers 9, 10. A gear 1*e* is provided on the outer surface of the drum 1. A motor 11 is connected to a pinion 12 which is engaged with the gear 1*e*.

A device for feeding hot air 14*a*, for example, a burner 14, is provided so that the hot air can be blown upon the regenerated asphalt mixture in the exit 1*b* of the drum 1. It is preferable to control the temperature of the hot air 14*a* so as to avoid burning of the regenerated asphalt mixture.

In operation, the drum 1 is rotated by the motor 11 through the pinion 12 and the gear 1*e* at a predetermined speed. The used asphalt mixture 13, which is preferably crushed to some extent in advance, is fed through the chute 2 into the entrance 1*a* of the drum 1. The hot water is fed from one end 5*a* of the pipe 5 into the entrance 1*a* of the drum 1. The hot water thus fed flows down from the entrance 1*a* to the exit 1*a* by overflowing the dams 1*d*. At the same time, the used asphalt mixture or waste is scooped up by the blades in the hot water and comes to an upper position in the drum, and again falls into the hot water, repeatedly. As a result, the used asphalt mixture is subdivided so as to consist of many small aggregate particles each having an asphalt film on the surface thereof which exhibits no adhering tendency to each other. On the other hand, the asphalt mixture moves toward the exit 1*b* of the drum gradually by scooping up and falling of the mixture. The subdivided asphalt mixture is dried by the hot air 14*a* from the burner 14 and falls on the conveyer 4 which conveys the mixture to the next stage. The water is drained through the openings 1*f* into the water receptacle 3 and circulated by the pump 7 into the entrance 1*a* of the drum 1 by way of the pipe 5 while the water is purified and heated by the purifier 6 and the heater 8, respectively.

Figure 2:
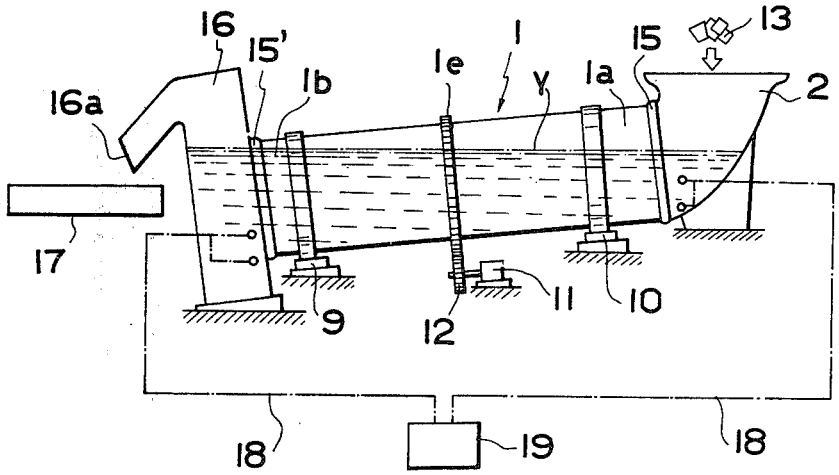
FIG. 2 is a schematic illustration of an asphalt recycling apparatus according to another embodiment of the present invention.
Figure 3:
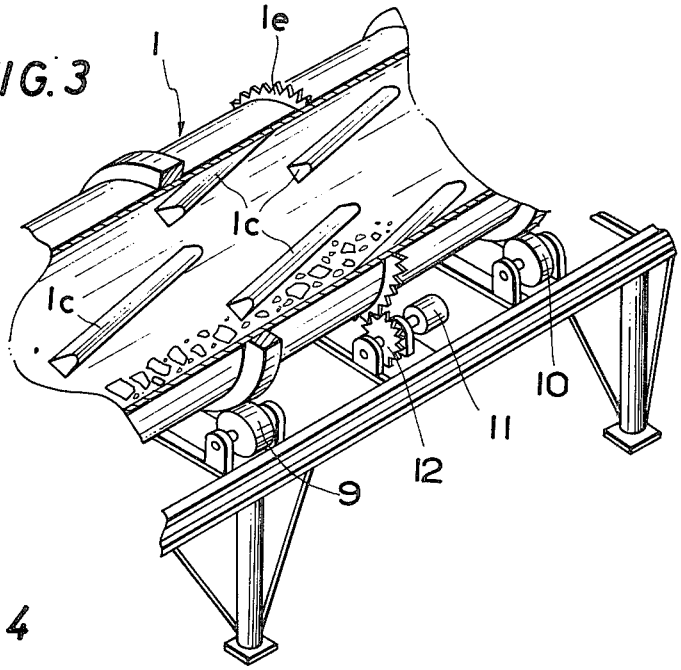
FIG. 3 is a schematic broken view, in section, of the asphalt recycling apparatus.
Figure 4:
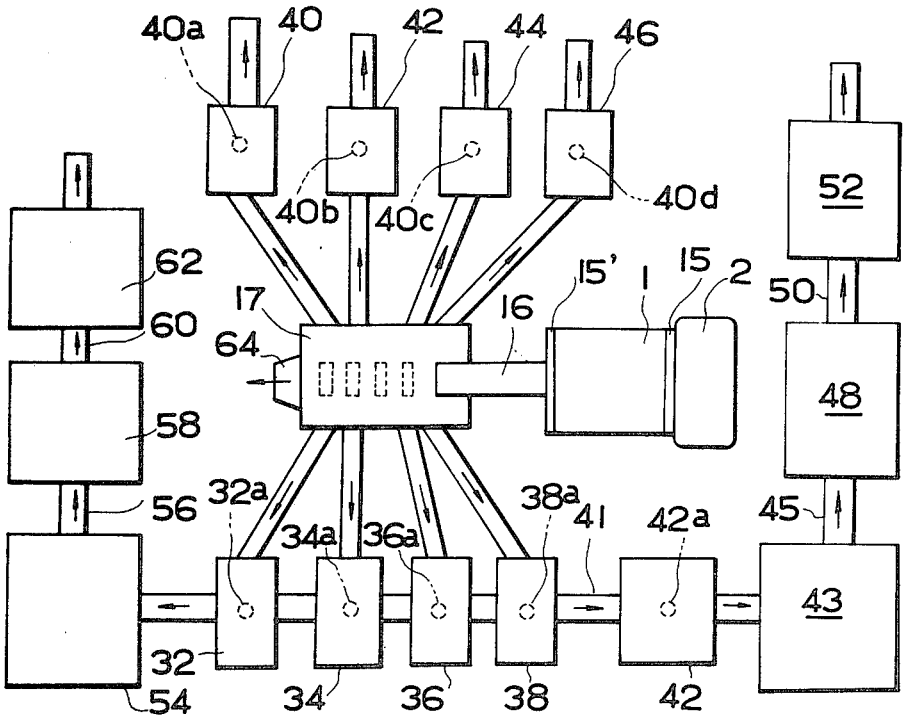
FIG. 4 is a schematic plan view of an asphalt recycle system according to another embodiment of the invention.

FIGS. 2, 3 and 4 show another embodiment according to the present invention.

A heating drum 1 is rotatably supported by supporting members 9 and 10. A big gear 1*e* is provided around the drum 1 and the gear engages with a pinion 12 connected with a motor 11. A mechanism using an endless chain may be used in place of the above gear system. The entrance or inlet 1*a* has an opening to be connected with an asphalt waste-feeding device 2 through a sealing means 15. The exit or outlet 1*b* of the drum 1 also has an opening and is connected with a hot elevator 16 through a sealing device 15'. The interior wall of the drum 1 is provided a number of blades 1*c*. In this embodiment, barrages or dams as shown in FIG. 1 are not present. Hot water is charged up to the level of a chain line designated at Y. A vibration sieve 17 is located at the outlet 16*a* of the hot elevator 16. One end of the pipe 18 is connected with a boiler 19 and the other end opens near to the sealing devices 15 and 15' thereby high temperature-high pressure steam is jetted into hot water in the drum 1.

A method for regenerating asphalt waste will be hereinafter illustrated referring to FIGS. 2 and 3.

Water is charged up to the level of a chain line designated at Y and it is heated to 80°–100° C. by feeding a heat transfer medium, i.e., high temperature-high pressure steam in the case of using the boiler 19, from a heating device, e.g., the boiler 19. As the heating device an oil heater, hot air generator and the like may be employed. Simultaneously with the above, the cylinder or drum 1 is rotated at a predetermined rate by a motor 11. Thereafter, asphalt waste 13 is fed thereinto from a feeding device 2. In such a case, it is preferred to crush same to pieces of about 10–20 cm square in advance with a crusher or the like. The asphalt waste fed is gradually transferred to left hand side in the cylinder 1 under being stirred by the blade 1*c*. At that time, it is reduced to pieces. When the pieces arrive the outlet 1*b* of the cylinder 1, they are in the form of aggregate particles which have been coated with asphalt film on their surfaces. Then, the asphalt aggregate particles thus obtained are transferred on the vibration sieve 17 with the hot elevator 16.

Referring to FIG. 4, the regenerated asphalt mixture sorted by the sorting means 16 (i.e., the mixture consisting of many aggregate particles each having an asphalt film on the surface thereof which have no adhering tendency to each other) is transferred to the respective feeder hoppers 32–46. The feeder hopper 32 receives the asphalt-film coated particles of 20 mm to 13 mm. The feeder hopper 34 receives those ranging from 13 mm to 5 mm. The feeder hopper 36 receives those of 5 mm to 2.5 mm. The feeder hopper 38 receives those less than 2.5 mm. Also, the feeder hopper 40, 42, 44, 46 receive those of 20 mm to 13 mm, those of 13 mm to 5 mm, those of 5 mm to 2.5 mm and those less than 2.5 mm, respectively. There is provided a conveyer 41 common to the feeder hoppers 32, 34, and 38. The conveyer 41 permits the asphalt mixture to move in both the right direction and the left direction according to a signal from the control unit (not shown). A reserve feeder hopper 41 is provided along with the conveyer 41. This reserve feeder hopper 41 is intended to contain some suitable mix materials. Provided at one end of the conveyer 41 is a room-temperature asphalt blend means 43 which in turn is connected with a room-temperature pug mill mixer 48 through the conveyer 45. The mixer 48 is connected through the conveyer 50 with a room-temperature asphalt storing means 52. Any desired amount of the room-temperature asphalt can be suitably taken out of the storing means 52 as the occasion demands. On the other hand, a variable heating dry asphalt blend means 54 is located at the other end of the conveyer 41. The dry asphalt blend means 54 is connected to a dry mixer 58 through a conveyer 56, and the dry mixer 58 is connected to a surge tank 62 through a conveyer 60. The heating asphalt mixture can be suitably taken out of the surge tank 62 as the occasion demands. The aggregate particles of the grain sizes greater than 20 mm are withdrawn in the direction of the arrow 64.

The feeder hoppers 32, 34, 36 and 38 are each provided with a valve, respectively, **32*a*, 34*a*, 36*a* and 38*a*. By controlling those valves with the control unit (not shown), the blend ratio of the asphalt mixture can be freely selected. Also, the feeder hoppers 40, 42, 44, and 46 can each provide asphalt mixture of uniform grain size, and have the valves 40*a* to 46*a***.

Figure 5:
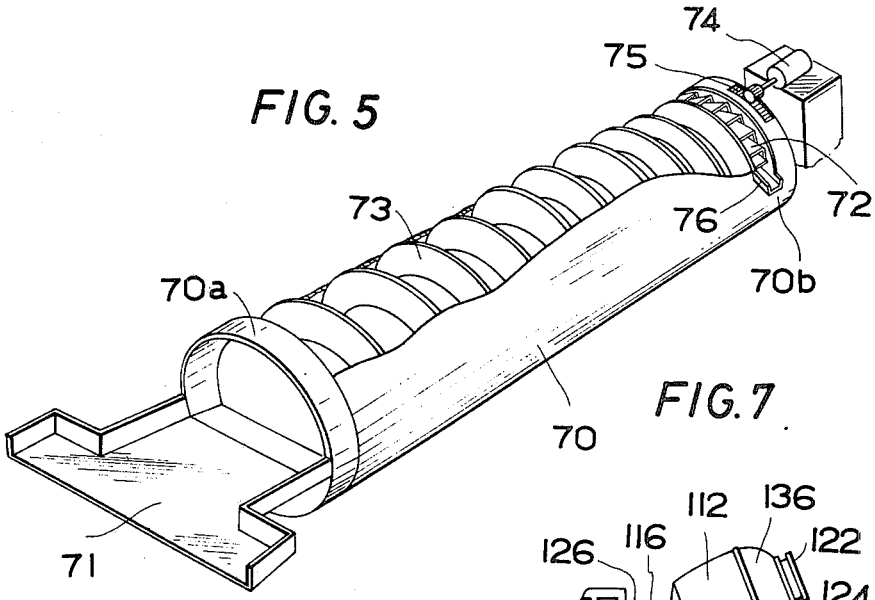
FIG. 5 is a schematic and broken perspective view of an apparatus for regenerating an asphalt waste according to another embodiment of the invention.
Figure 7:
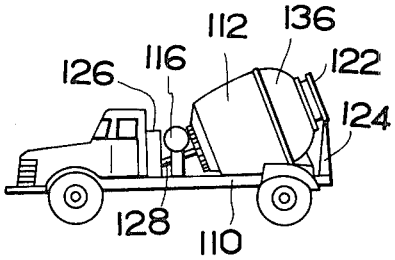
FIG. 7 is a front view of an asphalt recycle car according to another embodiment of the present invention.
Figure 6:
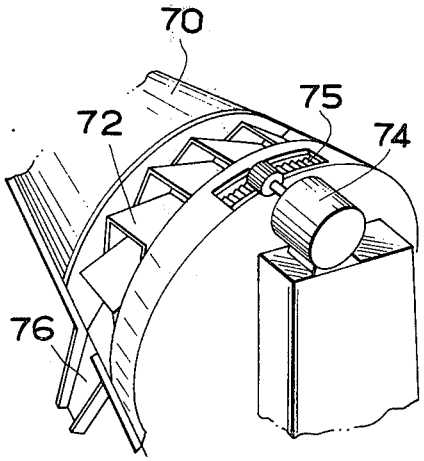
FIG. 6 is an enlarged perspective view showing a portion of the apparatus as shown in FIG. 5.

FIGS. 5 and 6 shown further embodiment of the invention.

There is provided an introduction chute 71 at the inlet **70*a* of drum or cylinder 70 as a feeding device for asphalt waste. As note above, the asphalt waste is preferably shattered in advance into pieces of 10–20 cm square. A bucket unit 72 is provided as a transferring device for asphalt waste at the exit 70*b* of the cylinder 70. In the drawings, a blade 73 of a helical form is rotatably provided all over the interior surface between the inlet 70*a* and outlet 70*b* in the interior of the cylinder 70. The blade may naturally be replaced with any blade other than helical form. The driving power of a motor 74 is transferred to a shaft (not shown) fixed with the blade 73 and the bucket unit 72 through a gear system 75 to drive the blade 73 and the bucket unit 72 at a predetermined rate. Water has been put into the interior of the cylinder 70** up to a predetermined level and it is heated by a heat transfer medium, for example, steam or hot air from a heater (not shown).

The asphalt waste fed from the introduction chute 71 sinks into hot water in the hot cylinder 50 to be transferred with stirring by the blade 73. At that time, the aggregates are separated or subdivided from each other and the regenerated asphalt composition thus subdivided is upwardly sent with the bucket 72 to be taken out from the discharging chute 76. A hot elevator may be used in place of the bucket 72.

FIGS. 7 to 11 shown still other embodiments of the invention.

There is rotatably provided a drum 112 slanted at 16–20 degrees on the chassis frame 110 of a car or vehicle and in the drum 112 various shapes of blades 114 (See FIG. 8) are equipped with to carry out introduction and subdivision or separation of asphalt waste and the other materials or blend and discharge of the resulting asphalt composition by the revolution of the drum. When discharging the asphalt composition the drum is thrown into reverse. The drum 112 may be rotated in a normal or reverse direction by the drum-driving apparatus 116 such as a motor depending upon one's wish. As the mechanism with which the drum 112 is rotated by the drum-driving apparatus 116, the well-known mechanism generally used in a cement-mixing car or vehicle may be employed. The driving power used in the mechanism may be obtained from the normal engine in the car or a special engine separately provided, and the driving system thereof may be a mechanical one or a hydraulic one.

In the drum 112, various shapes of blades 114 are fixed to the interior wall thereof as noted above, and the desired operation of the introducing, subdividing, blending and discharging steps may be carried out by the selection of the rotating direction of the drum.

In the shown embodiment, there have been used two tapering spiral blades. At the bottom of the drum 112, a heater 118 is provided. The heater 118 has a dual structure and the upper portion **118*a* is long and narrow. The end of same is supported by a plurality of supporting rods 120. The upper portion 118*a* of the heater 118 makes a tubular form whereby the hot air heated by a combustion gas can ascend in the upper portion 118*a* of the heater 118. The hot air is discharged into an inner space of the drum 112 from the end of the upper portion 118*a* of the heater 118. There is provided an opening at the end of the drum 112 and the asphalt composition and water may be charged or discharged therefrom. The opening of the drum 112 may preferably be equipped with a cover 122 to tightly close the drum 112 when heating. In view of safety, the cover 122 is equipped with a one-way valve (not shown) to automatically withdraw air from the interior of the drum 112 when inner pressure of the drum 112 reaches a predetermined valve. Designated at 124 is a metallic stairway thereby man can go up and down there. The stairway 124 rotatably supports the end of the drum 112 and further serves as a reinforcement for supporting the drum 112. Designated at 126 is a fuel-feeding device and the fuel is fed to the heater 118 through a pipe 128**.

Figure 9:
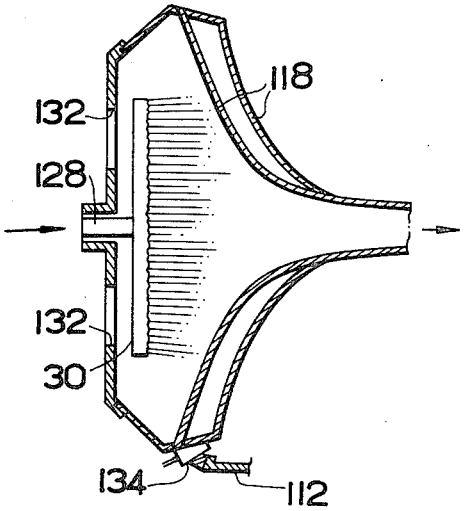
FIG. 9 is a sectional view showing a heater according to another embodiment of the present invention.

FIG. 9 shows an altered embodiment of the heater. The pipe 128 has been connected with a burner 130. Both pipe 128 and burner 130 are fixed and the drum 112 is rotated relative thereto.

There is provided an opening 132 at the bottom of the drum 112. Fuel fed to the burner 130 from the pipe 128 is sprayed to the heater 118 therefrom to be ignited.

Designated at 134 is a plug for discharging water and 136 is an auxiliary heater. The fuel fed from a fuel feeder 138 is burnt with a burner (not shown) of this auxiliary heater 136 and the drum 112 is heated from the outside thereof by the combustion heat. The auxiliary heater 136 has been fixed on the chassis frame 10 and the drum 112 revolves in the frame.

Now, the method for using the aforesaid asphalt-treating vehicle will hereinafter be illustrated.

First, water is put into the drum 112 up to a predetermined level and then asphalt waste is charged into the drum 112 from the opening thereof. At that time, water may of course be put into the drum after asphalt waste has been charged. When such preparation has been completed, the heater 118 is heated under rotating the drum 112 thereby heating water in the drum 112 to 90° C. or so. The asphalt waste will be softened by the hot water. Simultaneously with the softening of the asphalt waste, the asphalt waste is subdivided and separated from each other by the stirring action of the blade 114. Thus, a number of asphalt elements having asphalt coating on the surface of the aggregate may be obtained. When the asphalt waste has been softened and subdivided, a number of asphalt elements may be formed in the drum 112, these asphalt elements may be blended to form a regenerated asphalt composition by revolving the drum 112 in the same direction as is or may be once discharged from the drum 112 by reversely revolving the drum 112. In the latter case, if man wishes to heat the asphalt elements, such an operation is efficiently carried out by, for example, such a manner that the plug 134 is taken off to remove water in the drum 112,, and then the asphalt elements are again put into the drum 112 to heat and blend same.

Figure 8:
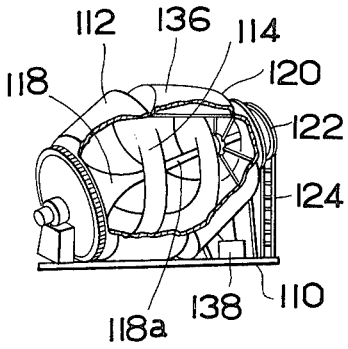
FIG. 8 is a broken perspective view showing a drum in the asphalt recycle car as shown in FIG. 7.
Figure 10:
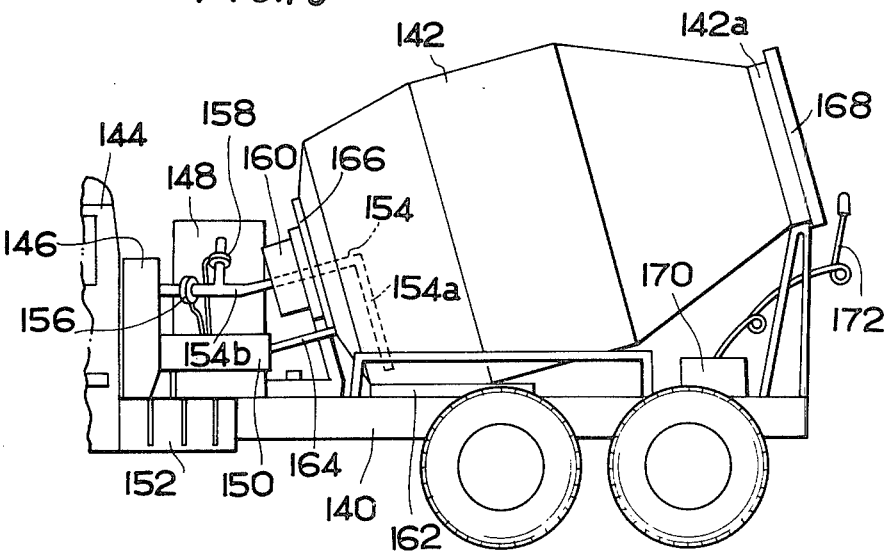
FIG. 10 is a front view of an asphalt recycle car according to another embodiment of the present invention.

FIG. 10 shows still another embodiment of the present invention. There is rotatably provided a drum 142 on a chassis frame 140. Further, a hot air feeder 146, a water tank 140 with a pump, a drum-driving device 150 and an oil reservoir for an operating oil used for these devices are arranged between the drum 112 and a driver's seat 44. In the inner space of the drum 112 blades (not shown), similar to those of the drum 112 as shown in FIG. 8, are provided and a desired operation of introducing, subdividing, blending and discharging steps may be carried out. In the embodiment of FIG. 10, the heater 118 present in the embodiment of FIG. 8 has not been provided and therefore, a vehicle having almost same internal structure of the drum as seen in a conventional cement-mixing vehicle may be used. However, in such a case it is normally required to provide a pipe 154 at the bottom of the drum 142 along the rotating center x of the drum 142. Although the pipe 154 is hermetically closed to the bottom of the drum 154, the drum 154 may revolve around the pipe 154. One end 154*a* of the pipe 154 extends downwardly and opens near the lowest surface of the drum 142. The other end 154*b* of the pipe 154 is connected with the hot air feeder 46 and the water tank 148. A hydraulic valve 156 opens and shuts the hot air stream from the hot air feeder 146. Another hydraulic valve 158 opens and shuts the water stream fed from the water tank 148 through a pump (not shown). These valves 156 and 158 may be manually operated.

Designated at 160 shows a supporting device for the drum 142. The drum 142 has been rotatably supported with the supporting device 160 and a supporting means 162 mounted on the chassis frame 140. Driving power is transferred from a drum-driving device 150 through a driving shaft 164 and a chain system 166 and the drum 142 is selectively revolved in a normal or reverse direction.

Designated at 170 is a vessel holding an additive for use in liquid asphalt and the additive is charged into the drum 142 through a hose 172 in a suitable amount.

The operation of the embodiment as shown in FIG. 10 will be described.

First, asphalt waste is put into the drum 142 from the upper opening 142*a* thereof. After asphalt waste has been charged up to a predetermined level the cover 168 is closed and then, the valve 156 of the hot air feeder 146 is closed. The other valve 158 is opened to feed water from the water tank 148 to the drum 142 through the pipe 154. When water is introduced up to a predetermined level in the drum 142, the valve 158 for use in the water tank 148 is closed. Thereafter, the valve 156 is opened to jet hot air from the end 154*a* of the pipe 154 into water present in the drum 142. At that time, the drum 142 may stand still but it is rather better to rotate it at a low rate in the normal direction to obtain good stirring of the contents. When the asphalt waste has been softened by the hot water the rate of revolution of the drum 142 is somewhat increased to subdivide or separate the aggregates in the asphalt waste. Thus, asphalt waste is first softened in water to subdivide aggregates present therein whereby a number of asphalt elements having asphalt coatings on the surfaces thereof may be obtained. Thereafter, these asphalt elements are discharged from the drum 142 by reversely rotating the drum 142.

In the case where water in the drum 142 is removed, the pump for use in the water tank 148 is thrown into reverse to discharge water through the pipe 154. The discharge of water may also be carried out by inserting a hose (now shown) from the upper opening 142*a* of the drum 142 or by providing a plug-plucking means at the bottom of the drum as shown in FIG. 9.

Figure 11:
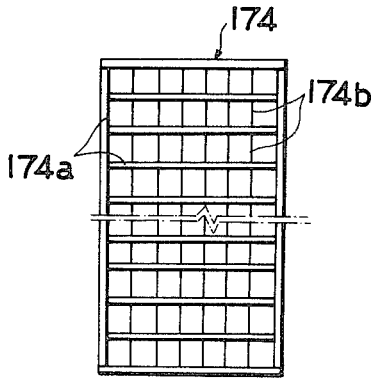
FIG. 11 is a plan view of a vibrating sieve which is used in the recycle car as shown in FIGS. 7 and 10.

Using this same apparatus to produce an asphalt composition of high temperature, a number of regenerated asphalt elements are put into the drum 142 from which water has been discharged and the upper opening 142*a* is closed with the cover 168. Thereafter, hot air is fed from the hot air feeder 146 through the pipe 154 under rotating the drum 142 in normal direction. When the asphalt elements become a predetermined temperature in such a manner, the valve 156 is closed and the cover 168 is opened. The asphalt elements of high temperature are discharged by reversely rotating the drum 142 to use these elements as an asphalt composition of high temperature. In such a case, it is preferable to sieve the composition into a desired size with the hot sieve 174. FIG. 11 shows an example of the hot sieve 174. A hollow pipe 174*a* is combined with a fine wire 174*b* and the Nichrome wire is provided in the pipe 174*a* to heat the sieve.

In FIG. 10, water is fed into the drum 142 through the pipe 154. However, the present invention is not limited to such a constitution. For example, the pipe 154 may be exclusively a passage for hot air and water may be fed from the upper opening 142*a* of the drum 142. Further, the pipe 154 and the end portion 154*a* show a simple embodiment only and the present invention may be constituted with other embodiments.

What I claim is:

1. Mobile apparatus for regenerating asphalt waste comprising:

a wheeled chassis;

a rotatable drum mounted on said chassis at an angle slanted with respect to the horizontal, said drum having an opening at its upper end for introduction of the asphalt waste and for discharge of the regenerated asphalt;

means for introducing water into said drum;

means for retaining water within said drum at a predetermined level;

means for heating the water retained in said drum;

reversible drive means for rotating the drum in one direction for the regeneration treatment and in the opposite direction for discharge of the regenerated asphalt; and blade means mounted on the interior of said drum and rotatable therewith for lifting the asphalt waste and repeatedly dropping it into the retained water as the drum rotates.

2. The mobile apparatus of claim 1 additionally comprising:

means for circulating hot air through the interior of said drum.

3. Apparatus for regeneration of asphalt waste comprising:

a chassis;

a rotatable drum mounted on said chassis at an angle slanted with respect to the horizontal, said drum having an opening at its upper end for introduction of the asphalt waste and an opening at its lower end for discharge of the regenerated asphalt;

means for introducing water into said drum;

means for retaining water within said drum at a predetermined level or levels;

means for heating the water retained in said drum;

blade means mounted provided within said drum; and means for rotating said blade means whereby the asphalt waste is repeatedly lifted and dropped into the water retained in the drum as it is transported by the blade means from the opening at the upper end of the drum toward the lower discharge opening.

4. The apparatus of claim 3 wherein the blade means is adfixed to the interior of the drum and rotates therewith.

5. The apparatus of claim 3 wherein said drum is fixed against rotation on said chassis.

6. The apparatus of claim 5 wherein said blade means is a helical screw.

7. The apparatus of claim 3 wherein said blade means include a plurality of elongated blade members.

8. The apparatus of claim 3 further comprising means to recirculate the retained water from the lower end of said drum to the upper end.

9. The apparatus of claim 3 wherein said means for retaining water includes at least one circumferential dam around the interior of said drum and located intermediate the ends of said drum, whereby the water is maintained on a plurality of levels within the drum.

* * * * *